United States Patent [19]

Kervin

[11] 4,413,676

[45] Nov. 8, 1983

[54] OIL WELL MONITORING DEVICE

[75] Inventor: Kendall G. Kervin, Scio, N.Y.

[73] Assignee: Well Research, Inc., Scio, N.Y.

[21] Appl. No.: 299,408

[22] Filed: Sep. 4, 1981

[51] Int. Cl.[3] ..... E21B 43/00; F04B 49/00

[52] U.S. Cl. ..... 166/53; 166/64; 166/66; 417/12

[58] Field of Search ..... 166/53, 64–66; 417/12, 43, 44, 63

[56] References Cited

U.S. PATENT DOCUMENTS

| | | | |
|---|---|---|---|
| 3,473,549 | 10/1969 | Moyer | 417/12 |
| 3,963,374 | 6/1976 | Sullivan | 417/12 |
| 4,102,394 | 7/1978 | Botts | 166/65 R |
| 4,118,148 | 10/1978 | Allen | 417/44 X |
| 4,171,932 | 10/1979 | Miller | 417/44 X |
| 4,224,988 | 9/1980 | Gibson et al. | 166/53 X |
| 4,286,925 | 9/1981 | Standish | 417/63 X |
| 4,341,504 | 7/1982 | Hignutt et al. | 417/63 X |

*Primary Examiner*—Ernest R. Purser
*Assistant Examiner*—Thuy M. Bui
*Attorney, Agent, or Firm*—Pearne, Gordon, Sessions, McCoy, Granger & Tilberry

[57] ABSTRACT

An automatic oil well control and monitoring system is disclosed which controls energization of a motor for an oil well pump jack. A first timer intermittently energizes the pump motor so that fluid flows from the well. A total pumping time clock is energized, as is an oil pumping time clock. If the pump begins to pump water, then a probe senses the water rather than oil, and this causes cessation of the oil pumping time clock energization and de-energization of a green indicator lamp. Upon pump-off of the well, a switch sensing fluid flow from the well is opened and the pump motor is de-energized. If no fluid is produced from the well after a time period following initial motor energization, a second timer is actuated to indicate a malfunction condition and a red light is illuminated. Also, the control circuit is continuously energized to maintain a lockout of the pump motor starter. The foregoing abstract is merely a resume of one general application, is not a complete discussion of all principles of operation or applications, and is not to be construed as a limitation on the scope of the claimed subject matter.

20 Claims, 2 Drawing Figures

Fig ~ 1

OIL WELL MONITORING DEVICE

BACKGROUND OF THE INVENTION

Many oil wells are initially naturally pressurized to cause the oil to flow to the surface. Later, many wells must be pumped to remove the oil from the subsurface formation. In such cases, a pump jack has typically been used to pump the liquid from the well. In many cases, as the oil is withdrawn, water begins to take its place and the pump jack begins to pump both oil and water. Some patented systems have proposed use of valves at the bottom of the oil well to close the valve when water is present so that water is not pumped from the well. Such systems are shown in U.S. Pat. Nos. 2,762,437 and 3,018,828. Another patented system is shown in U.S. Pat. No. 3,915,225, wherein the pump is turned off when the water level rises to the bottom of the well tubing in the well. U.S. Pat. No. 3,559,731 disclosed control of a pump jack which pumps off the well until there is inadequate flow. Then, after a first timer times out, the pump motor is de-energized. A second timer restarts the pump motor, but will shut down after a time period of the first timer unless there is adequate pump flow.

The typical experience in oil fields is to have short-cycle pumping, wherein the pump jack is operated for a short period of time to pump out the liquid in the oil well, and it may then be separated at the surface between oil and water. The oil well pumping is shut down periodically in order to permit the liquid to again fill up the reservoir in which the well casing is located. Since each well is different and presents different problems, a set time-on and time-off period for the individual pump jacks becomes quite difficult to determine, and each must be set individually and then can change with time as the oil is depleted from the underground formation. This has resulted in the pump jacks not operating for a sufficient length of time to pump off the well fluid, so that it is not an economical production from the well or, alternatively, the pump is operated for too long a time and the well is pumped off, pumping out all the liquids. This is even worse on the mechanical equipment because then the pump rods are subjected to pounding, and it has been observed that this is when most mechanical failures occur. It is also uneconomical to continue operation of the pump when no liquids are being pumped from the well.

U.S. Pat. Nos. 3,559,731 proposes a circuit to shut off the motor driving the pump jack when pump-off of the well occurs, but the control circuit is one which establishes high voltage at the well head, which could be a personnel hazard, and the circuit has limited interface with existing well head equipment. Additionally, there is no lockout feature to lock out the motor starter if there should be a malfunction in the pumping equipment, and thus cycling of the pump motor on and off will occur. Also, if there is a power failure to the electrical control circuit, the pump motor will be allowed to run continuously. In such circuit, a number of relay contacts are provided and failure or burnout of such contacts will allow the pump motor to run continuously. Should some fault occur due to failure of the circuit or circuit components, the entire circuit does not allow for pumping the well by conventional timing means. The commercially available pressure or flow sensing devices used in that circuit, especially in the northern climates, are not immune to freeze-up or paraffin buildup. Such circuit provides no means for recording the performance of the well, such as the time of pumping water and of pumping oil. That circuit provides no visual indication that well shutdown has occurred due to problems as distinguished from shutdown due to natural pump-off of the well. Also, if a fault should occur in that prior art circuit, due to failure of the relay coil of the first timer, continuous pumping of the well occurs, and such timer coil is energized during the entire time of flow of liquid from the well. Further, it is common to have more than one well pumping into a collection line and where the prior art circuit utilizes a pressure switch, then this also requires a check valve, and failure or leakage of such check valve will maintain the pump motor energized, with a second pump pumping into the same collection line.

SUMMARY OF THE INVENTION

The problem to be solved, therefore, is how to provide an oil well control and monitoring circuit which will overcome the above-mentioned disadvantages. Such problem is solved by an oil well monitoring device for an oil well having a motor-driven pump controlled by a first control switch, comprising, in combination, a housing adapted to be connected in the fluid flow exit from the pumped well, a fluid flow switch in said housing adapted to be actuated upon fluid flow from said well, a resistance probe in said housing to sense the resistance of the pumped fluid relative to the housing wall, and an electrical circuit for said motor, said electrical circuit including first means connected to said fluid flow switch for determining the existence of fluid flow from the well, said first means including hold-in contact means connected across the first control switch to maintain pump actuation despite first control switch opening, a total flow indicator controlled by said first means, second means including said resistance probe for determining the difference between oil flow and water flow and controlling an oil flow indicator, third means including a time switch to terminate pump motor energization upon an absence of fluid flow from the well despite the closed first control switch, and fourth means to maintain said third means energized despite de-energization of said pump motor.

This problem is further solved by an oil well monitoring device for an oil well having a motor-driven pump controlled by a first control switch, comprising, in combination, a fluid flow switch adapted to be mounted to be actuated upon fluid flow from said well, first means connected to said fluid flow switch for determining the existence of fluid flow from the well, timer means, means to energize said timer means only during pump-energized and non-flow conditions of the well, and said timer means including a time switch to terminate pump motor energization upon an absence of fluid flow from the well despite the closed first control switch.

This problem is further solved by an oil well monitoring device for an oil well having a motor-driven pump controlled by a first control switch, comprising, in combination, first means adapted to be connected to the well for determining the existence of fluid flow from the well, timer means including a time switch to terminate pump motor energization upon an absence of fluid flow from the well despite the closed first control switch, and lockout means to maintain said timer means energized despite de-energization of said pump motor to prevent cycling of the pump motor with a malfunctioning well.

Accordingly, an object of the invention is to ensure complete pump-off of an oil well before the pump jack is de-energized.

Another object of the invention is to provide asssurance of pump jack shutdown as soon as pump-off state of the well is achieved.

A further object of the invention is to provide a record of total operating time and of oil producing time as opposed to pumping of water.

A still further object of the invention is to provide visual indication that fluid being pumped is oil as distinguished from water.

Still another object of the invention is to provide shutdown of the pump jack and a lockout feature to save wear and tear on the equipment in case of equipment malfunction.

Another object of the invention is to provide visual indication that a malfunction exists.

A further object of the invention is to provide a circuit which permits the pump jack to return to its best, natural pumping cycle after excessive well downtime due to well servicing, power failure, etc.

Other objects and a fuller understanding of the invention may be had be referring to the following description and claims, taken in conjunction with the accompanying drawing.

DESCRIPTION OF THE PREFERRED EMBODIMENT

Figure 1:
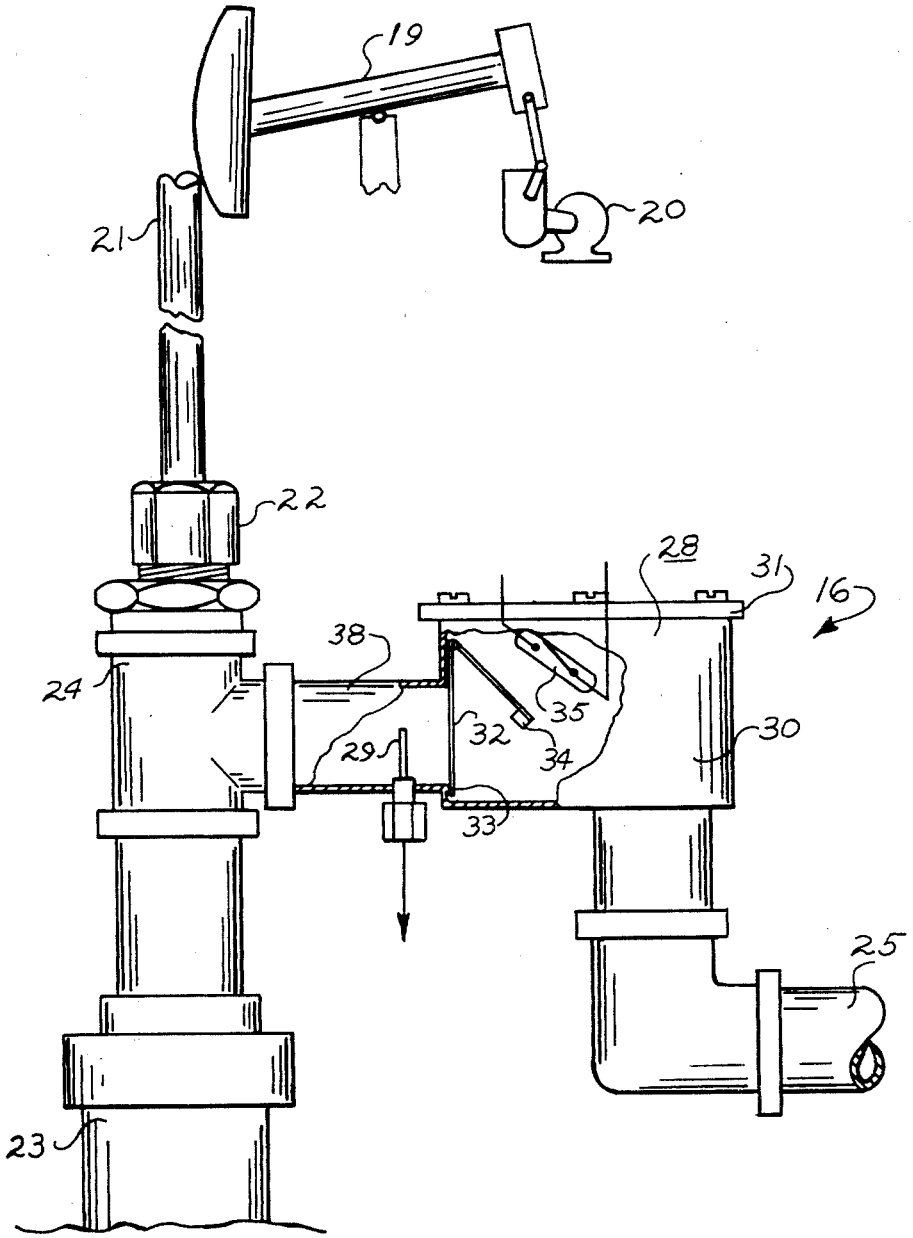
FIG. 1 is a vertical elevational view of the mechanical portion of the oil well monitoring system.
Figure 2:
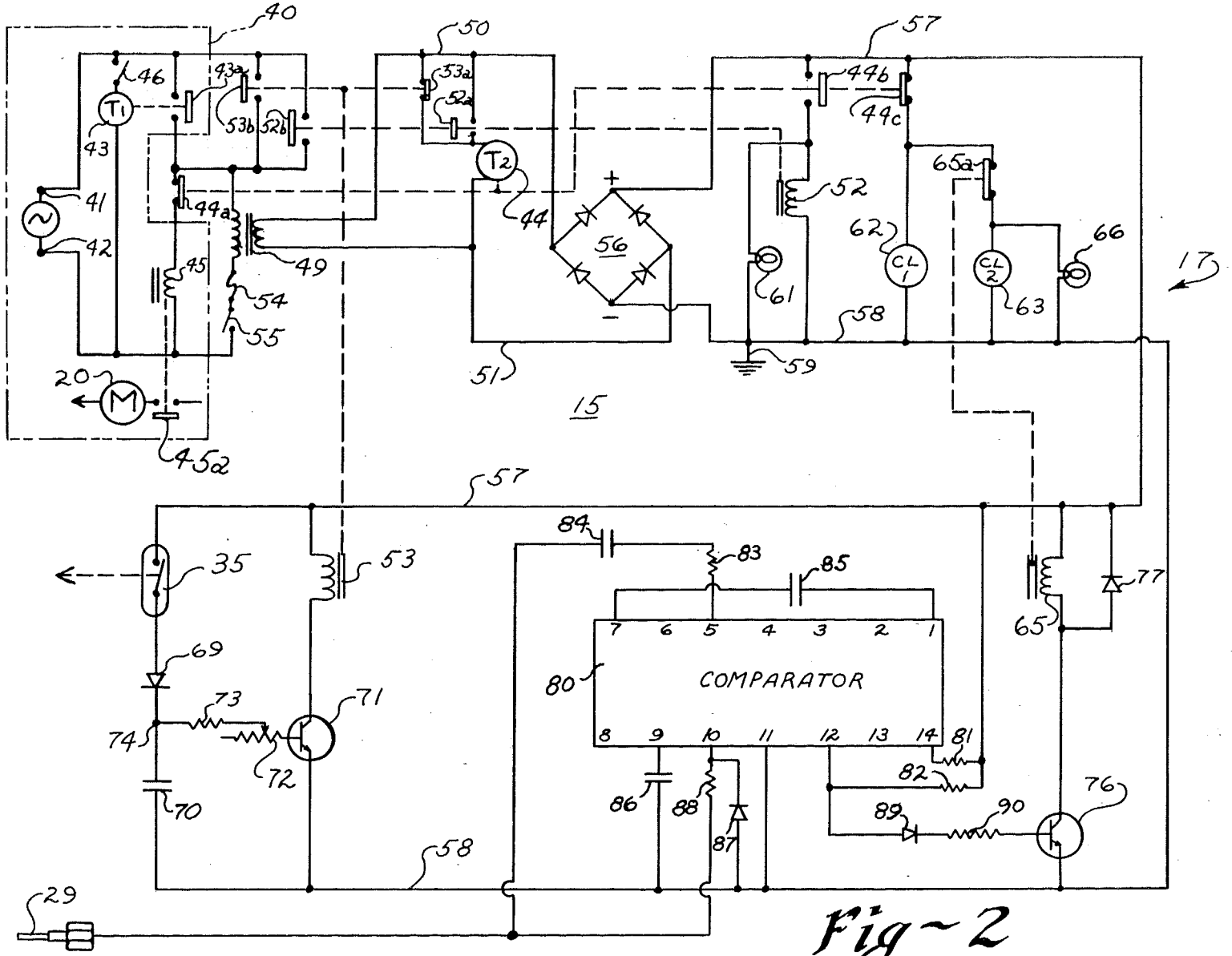
FIG. 2 is a circuit diagram of the electrical portion of the system.

FIGS. 1 and 2 together show the entire oil well control and monitoring system 15, with the mechanical system 16 shown in FIG. 1 and the electrical circuit 17 shown in FIG. 2. In FIG. 1, a pump jack 19 is rather diagrammatically shown driven by a pump motor 20 through a speed reducing unit to move a polish rod 21 in vertical reciprocation through a stuffing box 22 and into a well casing 23. The polish rod vertically reciprocates pump rods to pump oil upwardly from an underground reservoir at the bottom of the well casing and out through a Tee 24 to a pipeline 25. This may be part of a collection line serving several oil wells.

The mechanical system 16 is interposed between the Tee and the collection line 25, and includes a pulse generator 28 and a liquid sensing probe 29. The pulse generator 28 is provided in a housing 30 with a removable cover 31. A flapper valve or check valve 32 is provided inside the housing 30 and permits only one-way flow from the Tee 24 to the housing 30. This flapper valve 32 seals against a valve seat 33 and is urged closed by the weight of a permanent magnet 34 which, upon flow of liquid from the well casing 23, may coact with a flow sensing magnetic reed switch 35 to actuate this switch to the closed condition. The Tee 24 is connected to the housing 30 by a tube 38, preferably a brass tube which mounts in an insulated manner the liquid sensing probe 29. This probe senses the resistivity of the liquid being pumped, for example, either oil or water.

The electrical circuit 17 of FIG. 2 is used with the mechanical system of FIG. 1 and FIG. 2 shows the pump motor 20, as well as the flow sensing magnetic reed switch 35 and the probe 29. The pump motor 20 may be a part of existing well equipment 40, which includes AC energization terminals 41 and 42 for energization from a suitable source of commercial voltage, such as 220 or 440 volts. A first control switch **43*a* is a normally-open switch, and is connected through a normally-closed second timer switch 44*a* and through a motor starter coil 45 across the AC terminals 42. The motor starter coil 45 actuates normally-open contacts 45*a* in series with the pump motor 20 to energize this motor from a suitable voltage source upon closing of the contacts 45*a*. This suitable voltage source is usually the AC terminals 41 and 42. The first control switch 43*a* may be controlled in a number of ways, either by pressure or level of liquid in the well, but in this preferred embodiment this first control switch 43*a* is shown as controlled by a first timer 43. This first timer is connected across the AC terminals 42 by a switch 46. The aforementioned parts, except for the second timer switch 44*a*, may be considered the existing well equipment 40 to which the electrical circuit 17** of the present invention is connected.

The electrical circuit 17 includes a current transformer 49 with a low voltage secondary establishing 24 volts AC, for example, across conductors 50 and 51. A second timer coil 44 is connected across these conductors through a normally-open relay contact **52*a*. A normally-closed relay contact 53*a* is connected in parallel with the contact 52*a*. Normally-open relay contacts 53*b* and 52*b* are connected in parallel, and this parallel combination is connected in series with the primary of the current transformer 49 through a fuse 54 and a power switch 55, for energization from the AC terminals 41 and 42**.

The low voltage AC conductors 50 and 51 energize a DC bridge rectifier 56 to provide positive DC on a conductor 57 relative to negative conductor 58. This negative conductor 58 is preferably grounded at 59. A non-flow relay 52 is energizable from the DC conductors 57 and 58 through a normally-open second timer relay contact **44*b*. A red indicator lamp 61 is connected in parallel with the non-flow relay 52. A first indicator clock 62 is energizable from the DC conductors 57 and 58 through normally-closed second timer contacts 44*c*. A second indicator clock 63 is energizable from the DC conductors 57 and 58 through the contacts 44*c* and a normally-closed relay contact 65*a*. A green indicator lamp 66 is energizable across the second indicator clock 63**.

The flow sensing reed switch 35 is connected through a diode 69 and a capacitor 70 between the DC conductors 57 and 58. A flow relay 53 is connected between the conductors 57 and 58 through the main terminals of a transistor 71. In the transistor shown, this is a collector and emitter. The base of this transistor 71 is connected through a rheostat 72 and a resistor 73 to a terminal 74 at the junction between the diode 69 and capacitor 70. A difference relay 65 is connected between the DC conductors 57 and 58 through the main terminals of a second transistor 76. Again, these main terminals are shown as the collector and emitter of this transistor. A back diode 77 is connected across the relay coil 65 in a polarity to conduct current toward the conductor 57.

A comparator 80 is connected for power from the DC conductors 57 and 58 through resistors 81 and 82 to the comparator terminals 14 and 12, respectively. Terminal 11 of the comparator is connected to the ground conductor 58. A resistor 83 and capacitor 84 connect comparator terminal 5 to the probe 29 and a capacitor 85 interconnects comparator terminals 1 and 7. A capacitor 86 connects comparator terminal 9 to the ground conductor 58 and a diode 87 is connected in a polarity to conductor current from the negative conductor 58 to comparator terminal 10. A resistor 88 connects this comparator terminal 10 to the water sensing probe 29. A diode 89 and resistor 90 are connected in polarity to conduct current from comparator terminal 12 to the base of the second transistor 76.

OPERATION

The oil well control and monitoring system 15 is usable with existing oil well equipment 40, and is designed to interface usually with such existing electrical pump jack systems presently in use in the oil fields. Most of these systems consist of some form of control contacts 43*a*, for example, a first timer, to periodically close these contacts 43*a* to start the pump jack and pump off whatever liquid has collected in the underground reservoir. Hopefully, this liquid is oil, but often water has collected and will be pumped out after the oil has been pumped off. When such timer contacts 43*a* are periodically closed, this energizes the motor starter 45 to close motor starter contacts 45*a* and energize the pump motor 20. In so doing, the pump jack 19 is actuated, the polish rod 21 is reciprocated, and liquid is pumped from the well casing 23. The well tubing should be full of liquid, as held by a check valve at the bottom of the tubing string, but sometimes this valve leaks and the liquid column has decreased in height, so that liquid flow through the housing 30 is not immediate. Assuming that the check valve holds the liquid, then flow starts very promptly and the flapper valve 32 is opened by the liquid flow to cause the magnet 34 to be swung near the flow sensing magnetic reed switch 35. This actuates the switch 35 as the slugs of liquid flow through the body of the pulse generator 28. The pump may be single-acting or double-acting, with the pulsations accentuated with a single-acting pump. As these slugs of liquid flow through the body of the pulse generator, the flapper valve responds to the fluid by swinging on its hinge, bringing the magnet into proximity with the reed switch 35. Intermittent closing of the reed switch 35 passes current through the diode 69 to charge the capacitor 70, and this is of sufficiently large value to remain charged and pass a AC bias level to the base of transistor 71 to turn it on. This energizes the flow relay 53 to close the contact 53*b* and open contacts 53*a*.

Prior to the opening of these contacts 53*a*, the second timer 44 is energized for a short time but, upon opening of the contacts 53*a*, the second timer is de-energized and it is a resettable timer to reset to zero.

The transistor 71 will remain on as long as liquid is being pumped. The energization of the flow relay 53 and the closing of the contacts 53*b* thereof will provide a hold-in contact action for the motor starter 45, and thus the first timer 43 may be set at a minimum time interval, e.g., up to six minutes, so that it may now time-out and open the contacts 43*a*, thereby giving full control to the oil well monitoring system 15.

The closing of the timer contacts 43*a* energizes the current transformer 49 to supply AC power to the second timer 44 and to the rectifier bridge 56. This in turn supplies DC power to the conductors 57 and 58. The second timer 44 has not timed out and actuated, so the timer contacts 44*c* remain closed to energize the first and second indicator clocks 62 and 63, respectively. The first indicator clock 62 indicates total pumping time of the pump motor 20 and the second indicator clock 63 indicates the time that the pump is pumping oil as distinguished from pumping water. The green indicator lamp 66 is connected across the second indicator clock 63 to indicate the desirable condition of pumping oil as distinguished from water.

If the oil in the reservoir of the well has been depleted and the pump begins to pump water, then the probe 29 senses this change of resistance relative to the brass tube 38. The probe 29 has only a very low voltage thereon, such as 680 millivolts, for safety to avoid any sparks in the hazardous gaseous atmosphere surrounding the oil well. When the probe 29 is contacting oil, there is a very minimum (practically zero) current flow from the probe 29 to the grounded brass tube 38. However, when water is present, often this water is a salty water, which is a relatively good conductor, so about 450 milliamps of current, for example, will flow from the probe to the tube 38. The comparator 80 may be considered an amplifier to amplify this relatively high current compared to the current flow when oil is present. Usually, however, the comparator 80 is one which compares the current flow with a reference for a more positive action, and when the current flow exceeds the given reference, then a signal is passed through the diode 89 and resistor 90 to the base of the second transistor 76, thus turning on this transistor. This turn-on of the transistor energizes the difference relay 65, which opens the contact 65*a* thereof. This de-energizes the second indicator clock 63 and the green indicator lamp 66. Thus, the presence of water in the flow line will stop the oil flow indicator clock 63, but the total flow indicator clock 62 will remain energized. Thus, one may readily determine the total time of pumping and the total time of pumping oil by observing the two indicator clocks. Also, the illumination of the green lamp 66 will give a readily observable visual indication of pumping oil and the de-energization of this lamp, together with visual observation of the moving pump jack 19, will indicate that oil is not being pumped.

As the well reaches a pumped-off state, liquid will cease to flow through the pulse generator 28. The potential at the base of the first transistor 71 will then fall to a low value and the first transistor 71 will turn off, thus de-energizing the flow relay 53. This opens the contact 53*b* to de-energize the pump motor, shutting down the pump jack and readying the oil well control and monitoring system 15 for the next pumping cycle as determined by the first timer 43.

The first timer 43 will again close the contacts 43*a* to initiate a second cycle, after a predetermined time period. If for some reason there is no liquid pumped from the well during a time period of up to six minutes, for example, as set by the second timer 44, then it should be assumed that there is a malfunction somewhere in the well equipment. There might be a hole in the well tubing, a broken pumping rod, or a defective foot valve, for example, so that no liquid is pumped through the pulse generator 28. In such case, the flow switch 35 is not actuated, the first transistor 71 is not turned on, and the flow relay 53 is not energized. Since the contacts 53*b* are not closed, the oil well pump 20 is being energized only through the first timer contacts 43*a*. The flow relay contacts 53*a* being closed will keep the second timer 44 energized until it times out, and it will then actuate the contacts 44*a* to an open condition, thus de-energizing the pump motor 20. At the same time, the contacts 44b are closed to energize the non-flow relay 52 and the red indicator lamp 61. Contacts 44c also open at this time to stop the first total indicator time clock 62. The energization of the non-flow relay 52 closes the contacts 52a and 52b thereof, with this closure acting as a lockout feature to maintain the current transformer 49 energized, thus supplying low voltage power to the control circuit and maintaining the second timer 44 energized to ensure complete lockout of the motor starter 45 until operating personnel observe the red indicator lamp 61 and investigate the cause of the malfunction. The lockout feature may be reset by switching the power switch 55 off and then on again.

If a malfunction within the oil well control and monitoring system 15 causes it to be inoperable, then normal operation by the timer 43 may be resumed or manual operation may be resumed by switching the power switch 55 to the off position.

The above description of the operation shows that the fluid flow switch 35 is a part of a means connected in the circuit to determine the existence of fluid flow from the well. This flow determining means includes hold-in contacts 53b which are connected across the first control switch 43a to maintain pump actuation despite opening of this first control switch 43a. The resistance probe 29 is a part of a means for determining a difference between oil flow and water flow, and this difference determining means includes the second transistor 76 and the difference relay 65. The second timer 44 is included in a means to terminate pump motor energization upon an absence of fluid flow from the well despite the closed first control switch 43a. The non-flow relay 52 is a part of a lockout means to maintain energized the second timer 44 despite de-energization of the pump motor 20. It will be noted that this second timer 44 is energized only during pump-energized and non-flow conditions of the well, and hence this is only rare or intermittent energization of the second timer 44 to lengthen the life of this vital component of the system 15.

The above system ensures a well pump-off state before the pump motor 20 is de-energized. Concomitantly, the shutdown of the pump jack is assured as soon as the pumped-off state of the well is achieved. The first indicator clock 62 provides a record of the total operating time of the pump jack, and the second indicator clock 63 provides a record of the time that the well is producing oil as distinguishing from pumping water. The illumination of the green indicator lamp 66 and the motion of the pump jack 19 provide visual indication that the fluid being pumped is oil as distinguished from water. This may be observed from quite a distance in the oil well field. The second timer 44 and non-flow relay 52 provide shutdown and lockout features to save wear and tear on the equipment in case of some equipment malfunction, for example, a hole in the well tubing or parted rods, etc. The illumination of the red indicator lamp 61 provides visual indication for quite a distance throughout the oil well field that a malfunction exists in that particular oil well so that operating personnel will be alerted to such malfunction. The system 15 allows the oil well to automatically return to its natural pumping cycle after excessive well downtime due to well servicing, power failure, etc. During such excessive well downtime, the oil reservoir may fill up to a much greater extent than normal, and therefore during the very first pumping cycle after this shutdown the well will pump for a long period of time to a pumped-off state. This would not be the case with operation merely by the timer 43.

In one actual circuit constructed in accordance with the invention the values of the circuit components were as follows:

| Reference No. | Item | Value/Type |
|---|---|---|
| 70 | Capacitor | 4.7 mfd 35 volt |
| 84 | " | .05 mfd 35 volt |
| 85 | " | .001 mfd 35 volt |
| 86 | " | 20 mfd 35 volt |
| 72 | Rheostat | 50,000 ohms |
| 73 | Resistor | 50,000 ohms ¼ watt |
| 81 | " | 4,7000 ohms ¼ watt |
| 82 | " | 3,300 ohms ¼ watt |
| 83 | " | 56,000 ohms ¼ watt |
| 88 | " | 4,700 ohms ¼ watt |
| 90 | " | 4,700 ohms ¼ watt |
| 69 | Diode | 1N 4001 |
| 77 | " | 1N 4001 |
| 87 | " | 1N 914 |
| 89 | " | 1N 4001 |
| 80 | Integrated Circuit | National LM 1830 |
| 71 | Transistor | 2N2222 |
| 76 | " | 2N2222 |

The present disclosure includes that contained in the appended claims, as well as that of the foregoing description. Although this invention has been described in its preferred form with a certain degree of particularity, it is understood that the present disclosure of the preferred form has been made only by way of example, and that numerous changes in the details of the circuit and the combination and arrangement of circuit elements may be resorted to without departing from the spirit and scope of the invention as hereinafter claimed.

What is claimed is:

1. An oil well monitoring device for an oil well having a motor-driven pump controlled by a first control switch, comprising, in combination:

a housing adapted to be connected in the fluid flow exit from the pumped well;

a fluid flow switch in said housing adapted to be actuated upon fluid flow from said well;

a resistance probe in said housing to sense the resistance of the pumped fluid relative to the housing wall; and an electrical circuit for said motor;

said electrical circuit including first means connected to said fluid flow switch for determining the existence of fluid flow from the well, said first means including hold-in contact means connected across the first control switch to maintain pump actuation despite first control switch opening, a total flow indicator controlled by said first means, second means including said resistance probe for determining the difference between oil flow and water flow and controlling an flow indicator, third means including a time switch to terminate pump motor energization upon an absence of fluid flow from the well despite the closed first control switch, and fourth means to maintain said third means energized despite de-energization of said pump motor.

2. An oil well monitoring device as set forth in claim 1, wherein said first control switch is a periodically actuated time switch.

3. An oil well monitoring device as set forth in claim 1, including a semiconductor in said first means biased between on and off conditions with actuation of said fluid flow switch.

4. An oil well monitoring device as set forth in claim 1, including a transistor in said first means biased between on and off conditions with actuation of said fluid flow switch.

5. An oil well monitoring device as set forth in claim 1, including an electromagnetic relay in said first means energizable to actuate said hold-in contact means.

6. An oil well monitoring device as set forth in claim 1, wherein said first means includes rectifier means connected to charge capacitive means by the closed condition of said fluid flow switch.

7. An oil well monitoring device as set forth in claim 1, wherein said second means includes indicator lamp means to indicate the difference between oil and water flowing from the pumped well.

8. An oil well monitoring device as set forth in claim 1, wherein said second means includes comparator means to compare the electrical resistance of the fluid flowing from the well with a reference to determine the presence of oil or water.

9. An oil well monitoring device as set forth in claim 8, including a transistor connected to be made conductive by the output of said comparator means.

10. An oil well monitoring device as set forth in claim 9, including a relay connected to be actuated by the output of said transistor.

11. An oil well monitoring device for an oil well having a motor-driven pump controlled by a first timer-controlled switch, comprising, in combination:

a fluid flow switch adapted to be mounted to be actuated upon fluid flow from said well;

first means connected to said fluid flow switch for determining the existence of fluid flow from the well;

second timer means;

means to energize said second timer means only during pump-energized and non-flow conditions of the well; and said second timer means including a time switch to terminate pump motor energization upon an absence of fluid flow from the well despite the closed first timer-controlled switch.

12. An oil well monitoring device as set forth in claim 11, wherein said second timer means includes normally-closed contacts of said time switch connected in series with said first control switch.

13. An oil well monitoring device as set forth in claim 11, wherein said energization means includes a normally-closed contact of a flow relay responsive to said fluid flow switch.

14. An oil well monitoring device as set forth in claim 11, wherein said energization means includes a non-flow relay and normally-open contacts on said non-flow relay.

15. An oil well monitoring device as set forth in claim 14, wherein said energization means includes normally-open contacts of said second timer means in series with said non-flow relay.

16. An oil well monitoring device for an oil well having a motor-driven pump controlled by a first timer-controlled switch, comprising, in combination:

first means adapted to be connected to the well for determining the existence of fluid flow from the well;

second timer means including a time switch to terminate pump motor energization upon an absence of fluid flow from the well despite the closed first timer-controlled switch; and lockout means to maintain said second timer means energized despite de-energization of said pump motor to prevent cycling of the pump motor with a malfunctioning well.

17. An oil well monitoring device as set forth in claim 16, wherein said time switch is connected in series with said first timer-controlled switch.

18. An oil well monitoring device as set forth in claim 16, wherein said lockout means includes a non-flow means responsive to the absence of fluid flow from the well to maintain said second timer means energized.

19. An oil well monitoring device as set forth in claim 16, wherein said lockout means includes normally-open contacts of a non-flow relay connected to energize said second timer means upon the absence of fluid flow from the well.

20. An oil well monitoring device as set forth in claim 16, wherein said first means includes normally-closed contacts of a flow relay connected to energize the pump motor upon existence of fluid flow from the well.

* * * * *

UNITED STATES PATENT AND TRADEMARK OFFICE

CERTIFICATE OF CORRECTION

PATENT NO. : 4,413,676

DATED : November 8, 1983

INVENTOR(S) : Kendall G. Kervin

It is certified that error appears in the above—identified patent and that said Letters Patent is hereby corrected as shown below:

Column 3, line 26, delete "be" (second occurrence) and insert --by--

Column 3, line 59, delete "casing"

Column 7, line 48, delete "distinguishing" and insert --distinguished--

Column 8, line 59, claim 1, after "an" insert --oil--

Signed and Sealed this

*Ninth* Day of *October 1984*

[SEAL]

*Attest:*

GERALD J. MOSSINGHOFF

*Attesting Officer*

*Commissioner of Patents and Trademarks*